US006739570B2

(12) United States Patent
Carlsen

(10) Patent No.: US 6,739,570 B2
(45) Date of Patent: May 25, 2004

(54) VALVE ELEMENT

(75) Inventor: Hans-Paul Carlsen, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 162 days.

(21) Appl. No.: 10/000,076

(22) Filed: Dec. 4, 2001

(65) Prior Publication Data

US 2002/0066875 A1 Jun. 6, 2002

(30) Foreign Application Priority Data

Dec. 4, 2000 (NO) ..... 2000 6144

(51) Int. Cl.[7] ..... F16K 51/00
(52) U.S. Cl. ..... 251/1.3; 251/212; 166/55
(58) Field of Search ..... 251/1.3, 1.1, 212; 166/55

(56) References Cited

U.S. PATENT DOCUMENTS 2,132,037 A * 10/1938 MacClatchie ..... 251/1.3
2,855,172 A * 10/1958 Jones ..... 251/212
2,934,148 A * 4/1960 Allaire ..... 251/1.3
2,947,508 A * 8/1960 Allen ..... 251/212
4,508,313 A * 4/1985 Jones ..... 251/1.3
4,845,814 A 7/1989 Crook
5,287,879 A 2/1994 Leggett et al.
5,400,857 A * 3/1995 Whitby et al. ..... 251/1.3
5,931,442 A 8/1999 Cummins

FOREIGN PATENT DOCUMENTS

| | | |
|---|---|---|
| GB | 1 311 196 | 3/1973 |
| NO | 138257 | 4/1978 |
| WO | 86/02705 | 5/1986 |

* cited by examiner

*Primary Examiner*—Gene Mancene
*Assistant Examiner*—John Bastianelli
(74) *Attorney, Agent, or Firm*—Young & Thompson

(57) ABSTRACT

A safety valve of the type where two valve elements (4) in a bore (3) can be moved towards each other for closing a flow path (2). Each valve element comprises two parts (10, 20), each of which is connected to an actuator (5, 6), thus enabling them to be moved independently of each other.

20 Claims, 1 Drawing Sheet

VALVE ELEMENT

BACKGROUND OF THE INVENTION

The present invention relates to a valve element for a safety valve, wherein the safety valve comprises a valve casing, which defines a flow path, a bore through the casing arranged transversally to the flow path together with identical and oppositely directed valve elements movably mounted in the bore.

The invention is particularly suitable for use in a blowout preventer when performing cable, wire or coiled tubing operations in a subsea oil or gas well.

DESCRIPTION OF THE RELATED ART

When working in a well it is necessary to establish a safety barrier against blowout. This is placed on the Christmas tree and ensures that the well is under control when the well valves have to be opened in order to gain access to the well. Use is normally made of several valves with different functions, which are stacked on top of one another. A common valve assembly, for example, is composed of a pipe ram, a shear ram and a blind ram.

A disadvantage with the known valves is the great heights they reach due to the fact that several valves are stacked on top of one another.

During intervention in a well use is often made of a wire, cable or string (a so-called "slick line"). When a wire is used, on account of the wire's construction a lubricator has to be employed, i.e. a device where a lubricant is pumped in between the wire and the seal. This lubricant penetrates the wire's core parts and ensures the necessary sealing, thus preventing well fluids from leaking past the valve. When a cable or string is used, a stuffing box may be employed instead. This is of a much simpler construction.

From U.S. Pat. No. 5,287,879 the combination is previously known of a lubricator and a safety valve for use in wire operations. This comprises two identical but oppositely directed valve elements ("rams"), which are moved towards each other in order to close a flow path. In the front of each valve element a special seal is mounted in order to seal round the wire as well as to add a lubricant to the seals. This lubricant penetrates the wire's core parts and ensures the necessary seal, thus preventing well fluids from leaking past the valve when it is closed.

The advantage of the above-mentioned valve is that it is a combination of lubricator and safety valve, but it is of a complex design, particularly on account of the need for a lubricant. It is therefore desirable to use a cable instead, but to combine a stuffing box with a valve that is strong enough to prevent blowout, has so far been impossible.

SUMMARY OF THE INVENTION

Thus it is an object of the invention to provide a valve, which is more compact than the previously known valves. This is achieved by having the valve element split into one or more parts, where each part is independently movable and driven by its own actuator.

A drawback with wire or cable operations is that means must be available both for sealing around the cable or wire and for closing the well. With the present invention the object is achieved that a valve can be given a dual function, whereby it can act as both a sealing valve and a stuffing box.

BRIEF DESCRIPTION OF THE DRAWINGS

The invention will now be described in greater detail with reference to the accompanying drawings, in which.

DESCRIPTION OF THE PREFERRED EMBODIMENT

Figure 1:
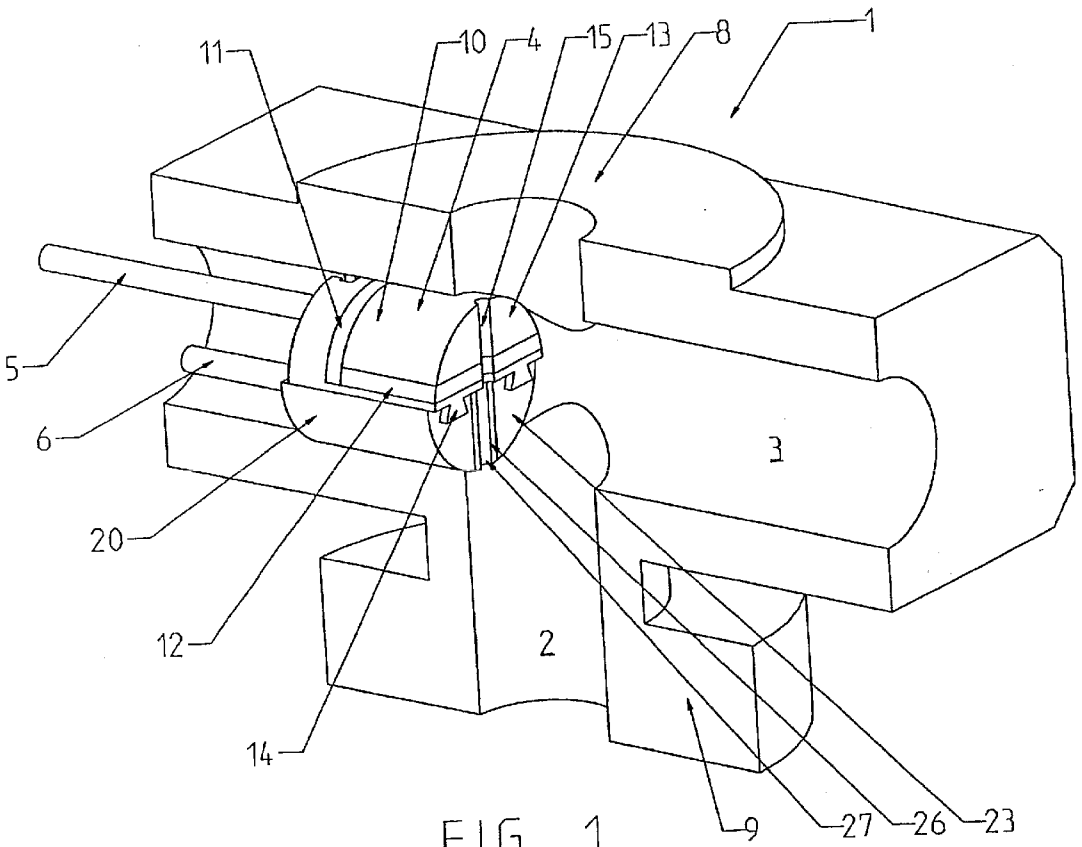
FIG. 1 is a partially sectional view of the invention.

In FIG. 1 there is illustrated a valve with a valve casing 1 through which there extends a flow channel 2, which, when the valve is mounted, for example on a Christmas tree, is axially coincident with the main channel of the well. The valve casing comprises upper 8 and lower 9 connecting flanges for connecting to corresponding flanges on additional valves, which can be stacked on top or underneath, or a pipe flange.

Through the casing 1 extends a transverse bore 3 located in approximately the same plane as the main channel 2 and preferably perpendicular thereto. In the bore are mounted valve elements, which are linearly movable in the bore. Only one valve element 4 is illustrated in the figure, it being understood that a second valve element is mounted on the opposite side of the main channel 2 and in such a manner that when the valve elements are moved towards each other by means of actuators, the channel is closed to the well stream in the known manner.

The valve element 4 is divided in a horizontal plane into an upper valve part 10 and a lower valve part 20. Each of the valve parts is connected to an actuator rod 5, 6, each of which is connected to an actuator (not shown), such as a hydraulic actuator for movement of the cylinder elements towards or away from each other.

The upper valve part 10 has a curved, preferably cylindrical surface against the bore 3. A first transverse seal 11 extends round the surface, providing a seal against the bore. A second longitudinal seal 12 extends along the front 13 and along the sides back to the first seal 11. The seals ensure that fluid in the channel 2 cannot leak past the valve. On the bottom of the valve part 10 dovetailed longitudinal ribs 14 are arranged.

The lower valve part has a corresponding cylindrical surface shape, where the curved part faces downwards and is adapted to the shape of the bore, thus enabling it to slide in the bore with a small clearance. On the top dovetailed slots 24 are milled out for engagement with the ribs 14 in the upper part. The two parts can thereby be moved forcibly relative to each other in a linear movement.

In addition the two valve parts can be guided in such a manner that one of the parts closes first or in the opposite case, that one of the parts opens first. This can be achieved by means of control of the fluid supply to the actuators or by means of a mechanical locking device. For example, the upper valve part 10 can be engaged first, followed by the lower valve part 20. In the same way, when the valve has to be opened, the upper part 10 can be caused to be opened first, whereupon the lower valve part is opened.

Figure 2:
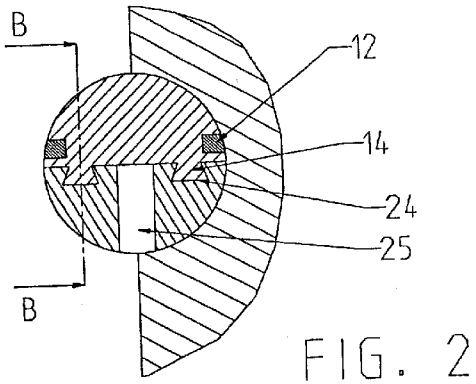
FIG. 2 is a vertical section through the valve element, across the valve element's axis, along the line A—A in FIG. 3.
Figure 3:
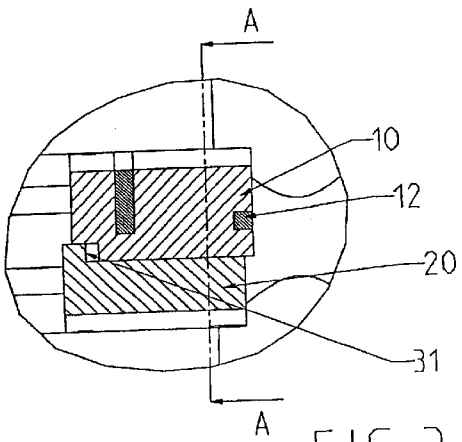
FIG. 3 is a vertical section through the valve element, along the valve element's axis, i.e. through the line B—B in FIG. 2.

Due to the fact that the slots 24 and the ribs 14 are not made through-going and that the grooves may be slightly longer than the ribs, the object is achieved that when the upper part is retracted, after some movement it will pull the lower part 20 along with it, as illustrated in FIG. 3 (the locking dog 31).

The valve part 11 comprises a front surface 23. This may be equipped with suitable means for a special function, for example an elastomer seal, a knife for cutting, a sealing and gripping device adapted to a pipe, etc.

In a preferred embodiment of the valve as it is illustrated in the drawings, it is employed as a combined stuffing box and cable lock for a cable, string or coiled tubing, which is inserted in the well. The upper valve part's 10 front surface 13 is equipped for this purpose with a vertical slit or groove 15 adapted to the cable's or the tubing's external diameter. The lower valve part 20 has a wider and larger vertical slit 25. In the slit 25 is mounted a seal 26 with a front slit 27 adapted to the cable's external diameter. The seal 26 is of an elastic material, which will enclose the cable in a sealing manner when the valve parts 11 move towards each other.

The groove 15 is closely adapted to the cable's external diameter, with the result that when the valve is completely closed, the upper valve part 10 will provide a seal round the cable while also holding it securely. With the use of slightly less force, however, the cable will be able to slide in the groove while a slight leakage is permitted past the valve.

During use the valve will act as a safety valve against blowout if an uncontrolled pressure build-up occurs in the well during intervention, i.e. when an instrument suspended in the cable is located down in the well.

The actuator is now influenced to move the upper valve part 10 to close the valve round the cable in order to isolate the well. Fluid might also be leaking past the lower valve part 20, with the result that the well pressure will act on the rear of the valve part 10, which is thereby further compressed.

The actuator for the lower valve part 20 is now influenced to close the valve part round the cable. When it has been ascertained that there is no leakage past the seal 26, the hydraulic pressure in the actuator for the upper valve part 10 can be reduced. The valve part 10 will thereby be able to move slightly backwards and reduce the pressure against the cable, with the result that there is less friction between the cable and the valve part 10. It will therefore be possible to move the cable through the valve. On account of the elastomer seal 26, the lower valve part 20 will act as a stuffing box.

In this manner the instrument in the well can be pulled up out of the well to a point where it passes the downhole safety valve, which can thereby be closed, for isolating the well. The remaining pressure over the downhole valve can then be bled off by suitable means. The valve 1 can now be opened and the instrument pulled up by the cable.

In a suitable embodiment the valve 1 is placed on the top of a lock pipe. In a situation like that described above, the instrument can be pulled all the way up in the lock pipe, thus enabling the valves in the Christmas tree or the blowout preventer to be closed underneath the instrument. The well is now under control and the remaining pressure in the lock pipe is restricted to a small volume, which can easily be circulated out.

Several other variants can be envisaged within the scope of the invention. For example, the valve element can be divided into a greater number of parts, with, for example, an upper part, a middle part and a lower part, each with its own function.

The valve provides lower constructional height and a more compact valve than the previously known safety valves against blowout, and is therefore particularly suitable for use as a spare safety valve in a subsea lubricator.

What is claimed is:

1. A valve element for use in a safety valve, which safety valve comprises a valve casing (1), which defines a flow path (2) for fluid and a bore (3) in the same plane but transverse to the flow path, where in the bore there are movably arranged coacting oppositely directed valve elements (4) for closing the flow channel, characterised in that at least one of the valve elements (4) comprises two or more valve parts (10, 20), which can be actuated independently of each other, wherein, a first of the two valve parts of the one valve element (4) is a lower valve part (20) facing the flow path when the one valve element is in a closed position, and a second of the two valve parts is an upper valve part (10) with a lower surface slideably bearing against an upper surface of the lower valve part.

2. A valve element according to claim 1, characterised in that the valve element (4) consists of three valve parts.

3. A valve element according to claim 1, characterised in that it comprises means (14, 24) for linear forced movement of the valve parts (10, 20) relative to each other.

4. A valve element according to claim 1, characterised in that the upper valve part (10) comprises a vertical groove (15) in its front end (13) for passing through a cable, string or tubing.

5. A valve element according to claim 1, characterised in that the lower valve part (20) comprises an elastomer seal (26) arranged in a slit (25) for sealing the flow path (2) when the valve is closed.

6. A valve element according to claim 5, characterised in that the seal (26) comprises a groove (27) for sealing round a cable, string or tubing.

7. A valve element according to claim 1, characterised in that one of the valve parts (10, 20) comprises a cutting device.

8. The valve element of claim 1, further comprising:

a rib and slot arrangement that interlocks the upper valve part with the lower valve part along the upper surface of the lower part.

9. A safety valve, comprising:

a vertical flow channel;

a transverse bore intersecting the flow channel, the bore having a first section on a first side of the flow channel and a second section on an opposite second side of the flow channel;

a first valve located in the first section and a second valve located in the second section, the first and second valves being alternatively movable to allow either one of the first and second valves to individually close the flow channel, at least one of the first a second valves comprising a lower valve part facing the flow channel, when in a closed position, and an upper valve part with a lower surface slideably bearing against an upper surface of the lower valve part, the lower and upper valve parts being actuated independently of each other.

10. The safety valve of claim 9, further comprising:

a rib and slot arrangement that interlocks the upper valve part with the lower valve part along the upper surface of the lower part.

11. The safety valve of claim 10, wherein the rib is a longitudinal dovetailed rib.

12. The safety valve of claim 10, further comprising:

a first actuator rod connected to the lower valve part; and a second actuator rod connected to the upper valve part, the second actuator rod located vertically over the first actuator rod.

13. The safety valve of claim 9, further comprising:

a first vertical slit located on an end face of the lower valve part; and a second vertical slit located on an end face of the upper valve part, the second vertical slit located in vertical alignment with the first vertical slit.

14. A valve element for use in a safety valve comprising a vertical flow channel, a transverse bore intersecting the flow channel, the bore having a first section on a first side of the flow channel and a second section on an opposite second side of the flow channel, the valve element comprising:

an outer perimeter sized to fit the valve element in either one of the first section and the second section so that the valve element could be moved to close the flow channel;

a lower valve part facing the flow channel, when in a closed position; and an upper valve part with a lower surface slideably bearing against an upper surface of the lower valve part, wherein the lower and upper valve parts originate from the same section, the lower and upper valve parts being actuated independently of each other.

15. The valve element of claim 14, further comprising:

a rib and slot arrangement interlocking the upper valve part with the lower valve part along the upper surface of the lower part.

16. The valve element of claim 15, wherein the rib is a longitudinal dovetailed rib.

17. The valve element of claim 14, further comprising:

a first actuator rod connected to the lower valve part; and a second actuator rod connected to the upper valve part, the second actuator rod located vertically over the first actuator rod.

18. The valve element of claim 14, further comprising:

a first vertical slit located on an end face of the lower valve part; and a second vertical slit located on an end face of the upper valve part, the second vertical slit located in vertical alignment with the first vertical slit.

19. The valve element of claim 18, further comprising:

a seal lining the first vertical slit.

20. The valve element of claim 14, further comprising:

a locking dog positioned on the upper surface of the lower valve part; and a notch within the lower surface of the upper valve part, the notch engaging against the locking dog so that retraction of the upper part pulls the lower part to open the flow channel.

* * * * *